US012084262B2

(12) United States Patent
Adams

(10) Patent No.: US 12,084,262 B2
(45) Date of Patent: Sep. 10, 2024

(54) VALVE FOR DISPENSING A FLOWABLE PRODUCT FROM A PRESSURIZED CONTAINER

(71) Applicant: Clayton Corporation, Fenton, MO (US)

(72) Inventor: William A. Adams, Fenton, MO (US)

(73) Assignee: Clayton Corporation, Fenton, MO (US)

( * ) Notice: Subject to any disclaimer, the term of this patent is extended or adjusted under 35 U.S.C. 154(b) by 0 days.

(21) Appl. No.: 18/168,998

(22) Filed: Feb. 14, 2023

(65) Prior Publication Data

US 2023/0192390 A1 Jun. 22, 2023

Related U.S. Application Data

(63) Continuation of application No. 17/357,744, filed on Jun. 24, 2021, now Pat. No. 11,597,585.

(60) Provisional application No. 63/043,547, filed on Jun. 24, 2020.

(51) Int. Cl.
*B65D 83/46* (2006.01)
*B65D 83/20* (2006.01)

(52) U.S. Cl.
CPC ..... *B65D 83/46* (2013.01); *B65D 83/205* (2013.01)

(58) Field of Classification Search
CPC ..... B65D 83/46; B65D 83/205; B65D 83/30; B65D 83/48
See application file for complete search history.

(56) References Cited

U.S. PATENT DOCUMENTS

| | | | | |
|---|---|---|---|---|
| 2,487,434 | A | 11/1949 | Geiss et al. | |
| 2,612,293 | A | 9/1952 | Michel | |
| 2,869,764 | A | 1/1959 | Collins | |
| 2,892,575 | A | 6/1959 | Turk | |
| 2,957,610 | A * | 10/1960 | Daniel | B65D 83/46 222/402.23 |
| 2,992,760 | A * | 7/1961 | Turk | B65D 83/46 222/402.23 |
| 3,219,069 | A | 11/1965 | Kuffer | |
| 3,300,105 | A | 1/1967 | Rosen | |
| 3,462,047 | A | 8/1969 | Hug et al. | |
| 3,489,323 | A | 1/1970 | Hug | |
| 3,722,760 | A | 3/1973 | Hug | |
| 3,747,812 | A | 7/1973 | Karman et al. | |
| 3,758,007 | A * | 9/1973 | Rosen | B65D 83/46 222/394 |

(Continued)

OTHER PUBLICATIONS

International Search Report and Written Opinion from PCT/US2021/039000, mailed Oct. 6, 2021, 10 pages.

*Primary Examiner* — Bob Zadeh
(74) *Attorney, Agent, or Firm* — Stinson LLP

(57) ABSTRACT

A valve dispenses flowable product from a container. The valve includes a mounting cup for mounting the valve on the container, a seal supported on the mounting cup, and a valve stem extending through the seal. The seal and the valve stem define a generally annular passage section of the valve passage that extends longitudinally along the valve axis radially between the valve stem and the seal. At least one of the valve stem and the seal includes a baffle extending transverse to the valve axis, the baffle defining a flow restriction along the generally annular passage section.

18 Claims, 15 Drawing Sheets

(56) References Cited

U.S. PATENT DOCUMENTS

| | | | | | |
|---|---|---|---|---|---|
| 3,920,165 | A | * | 11/1975 | Schultz | B65D 83/64 222/402.23 |
| 3,954,208 | A | * | 5/1976 | Brill | B65D 83/46 251/249 |
| 5,553,755 | A | | 9/1996 | Bonewald et al. | |
| 5,975,378 | A | | 11/1999 | Bayer | |
| 6,113,070 | A | * | 9/2000 | Holzboog | B65D 83/38 239/597 |
| 6,607,106 | B2 | | 8/2003 | Henry et al. | |
| 9,446,894 | B2 | | 9/2016 | Martz et al. | |
| 2006/0076365 | A1 | * | 4/2006 | Rueschhoff | B65D 83/48 222/402.1 |
| 2016/0009482 | A1 | | 1/2016 | Martz et al. | |
| 2020/0062490 | A1 | * | 2/2020 | Baker | B65D 83/40 |

* cited by examiner

VALVE FOR DISPENSING A FLOWABLE PRODUCT FROM A PRESSURIZED CONTAINER

CROSS-REFERENCE TO RELATED APPLICATION

The present application is a continuation of U.S. application Ser. No. 17/357,744, filed Jun. 24, 2021, which claims the benefit of U.S. Provisional Application Ser. No. 63/043,547, filed Jun. 24, 2020, the entirety of which is hereby incorporated by reference.

FIELD

The present disclosure generally relates to a valve for dispensing a flowable product from a pressurized container.

BACKGROUND

Valves for pressurized containers (e.g., aerosol containers) are well known. Known valves include a mounting cup, a stem, and a seal (e.g., a grommet) disposed between and interconnecting the stem and the mounting cup. The mounting cup is received in an opening on top of the container, and the mounting cup is crimped (clinched) or otherwise attached to the container. The seal is made of a resilient material and has an elongate neck which extends through a mounting opening in the mounting cup. The neck is constructed to form a fluid seal of the interface between the mounting cup and the seal. A typical stem includes an elongate tubular stem body with outlet and inlet(s) (orifices) at the upper and lower ends, respectively, and a disc (or button) at the lower end of the stem body. The stem body snugly fits through a bore defined by the seal to form a seal there between. The disc seats against a seat portion of the seal to form a leak proof seal when the valve is in a non-actuated position. The disc is movable away from the seat portion in an actuated position to allow product in the container, via pressure inside the container, to flow between the disc and the seat portion and through inlet(s) of the stem. Depending on the actuator used to operate the valve, the valve may function as a "vertically actuated" valve, whereby an axial force is applied to the stem to unseat the disc from the seat portion of the seal, or alternatively, as a "tilt" valve, whereby a rotational force is applied to the side of the stem to unseat the disc.

It is known to use vertically actuated valves and tilt valves to dispense flowable products from pressurized containers. For example, such valves are used to dispense aerated flowable products such as whipped cream.

SUMMARY

In one aspect, a valve for dispensing flowable product from a container has valve passage extending generally along a valve axis. The valve being configured so that product in the container is passable through the valve passage when the valve is opened to discharge product from the container. The valve generally comprises a mounting cup for mounting the valve on the container. A seal is supported on the mounting cup. A valve stem extending through the seal. The seal and the valve stem define a generally annular passage section of the valve passage that extends longitudinally along the valve axis radially between the valve stem and the seal. At least one of the valve stem and the seal comprises a baffle extending transverse to the valve axis. The baffle defines a flow restriction along the generally annular passage section.

In another aspect, a valve for dispensing flowable product from a container has a valve passage extending generally along a valve axis. The valve is configured so that product in the container is passable through the valve passage when the valve is opened to discharge product from the container. The valve comprises a mounting cup for mounting the valve on the container; a seal supported on the mounting cup; and a valve stem supported on the mounting cup such that movement of the valve stem can open the valve. The valve stem has a first end portion and a second end portion and a length extending generally along the valve axis from the first end portion to the second end portion. The valve includes one or more flow restrictions along the valve passage, and at least one of the one or more flow restrictions is located along the length of the valve stem.

In yet another aspect, a valve for dispensing flowable product from a container has a valve passage extending generally along a valve axis. The valve is configured so that product in the container is passable through the valve passage when the valve is opened to discharge product from the container. The valve comprises a mounting cup for mounting the valve on the container; a seal supported on the mounting cup; and a valve stem supported on the mounting cup such that movement of the valve stem can open the valve. The valve includes at least three discrete flow restrictions along the valve passage at spaced apart locations along the longitudinal axis.

BRIEF DESCRIPTION OF THE DRAWINGS

Corresponding reference numbers indicate corresponding aspects of the illustrated embodiments throughout the drawings.

DETAILED DESCRIPTION

The inventors have recognized that conventional vertically actuated valves and tilt valves for pressurized containers may cause aerated products, such as whipped cream, to splatter when dispensed. As will be explained in further detail below, to mitigate splattering the inventors have devised a valve with one or more integrated flow restrictions defined by baffles along the flow path through the valve. The flow restrictions create a tortuous flow path through the valve passage that retards or slows the flow of the product. The purpose of the flow restrictions are to sufficiently reduce the flow rate and/or pressure at which the aerated material is dispensed from the valve to reduce or minimize splattering.

Figure 1:
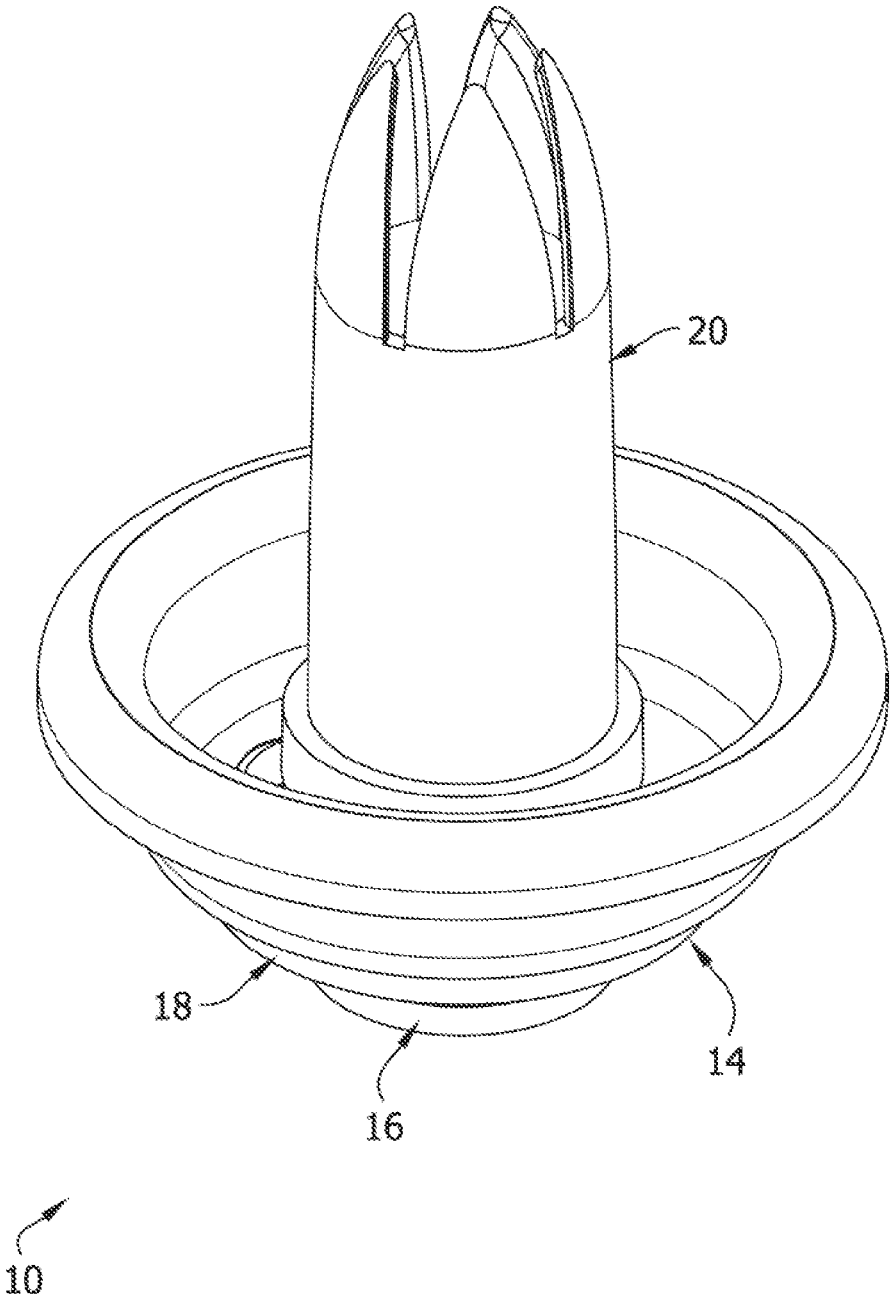
FIG. 1 is a perspective of an embodiment of a valve for dispensing flowable product from a pressurized container.
Figure 2:
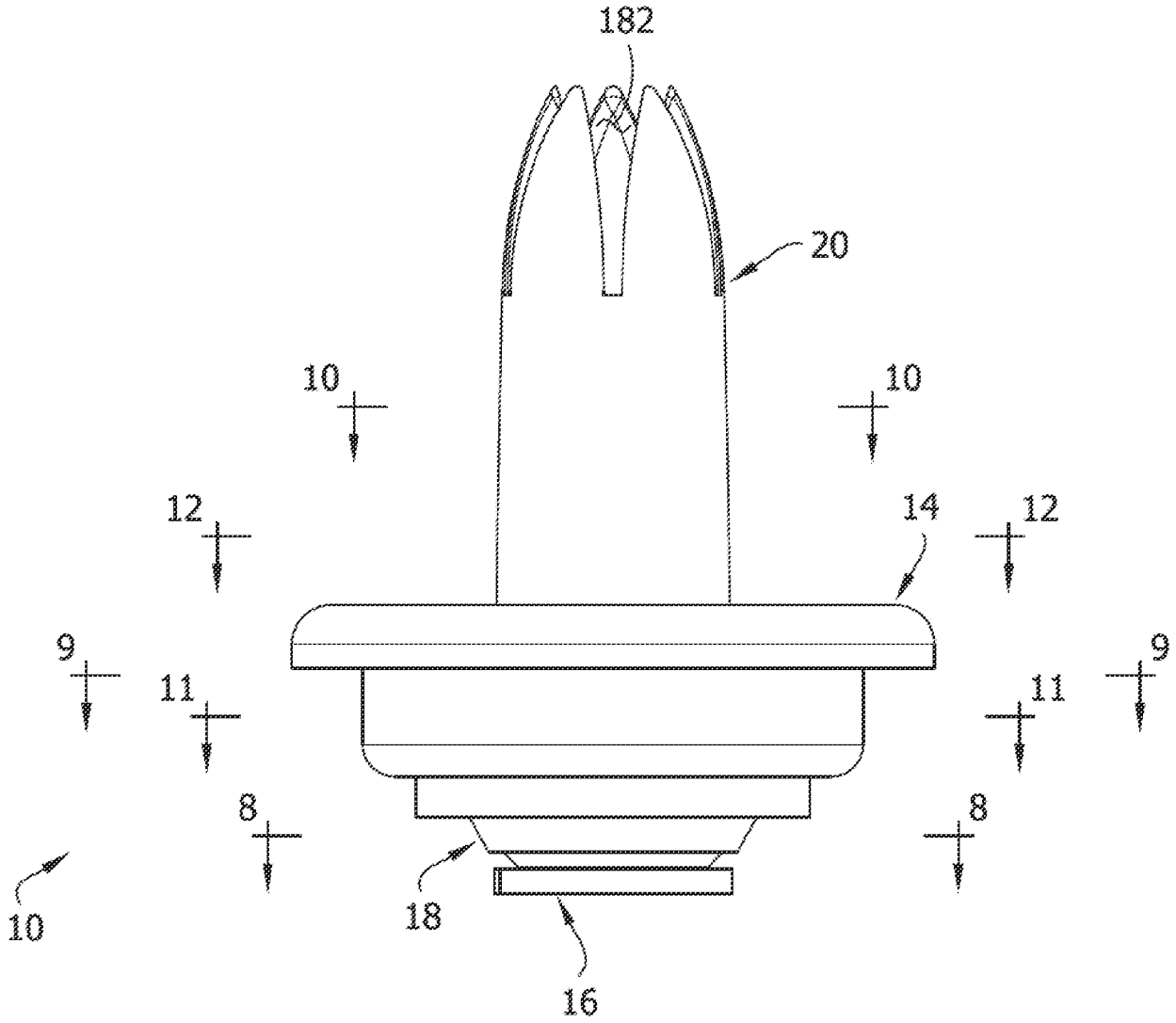
FIG. 2 is an elevation of the valve.
Figure 3:
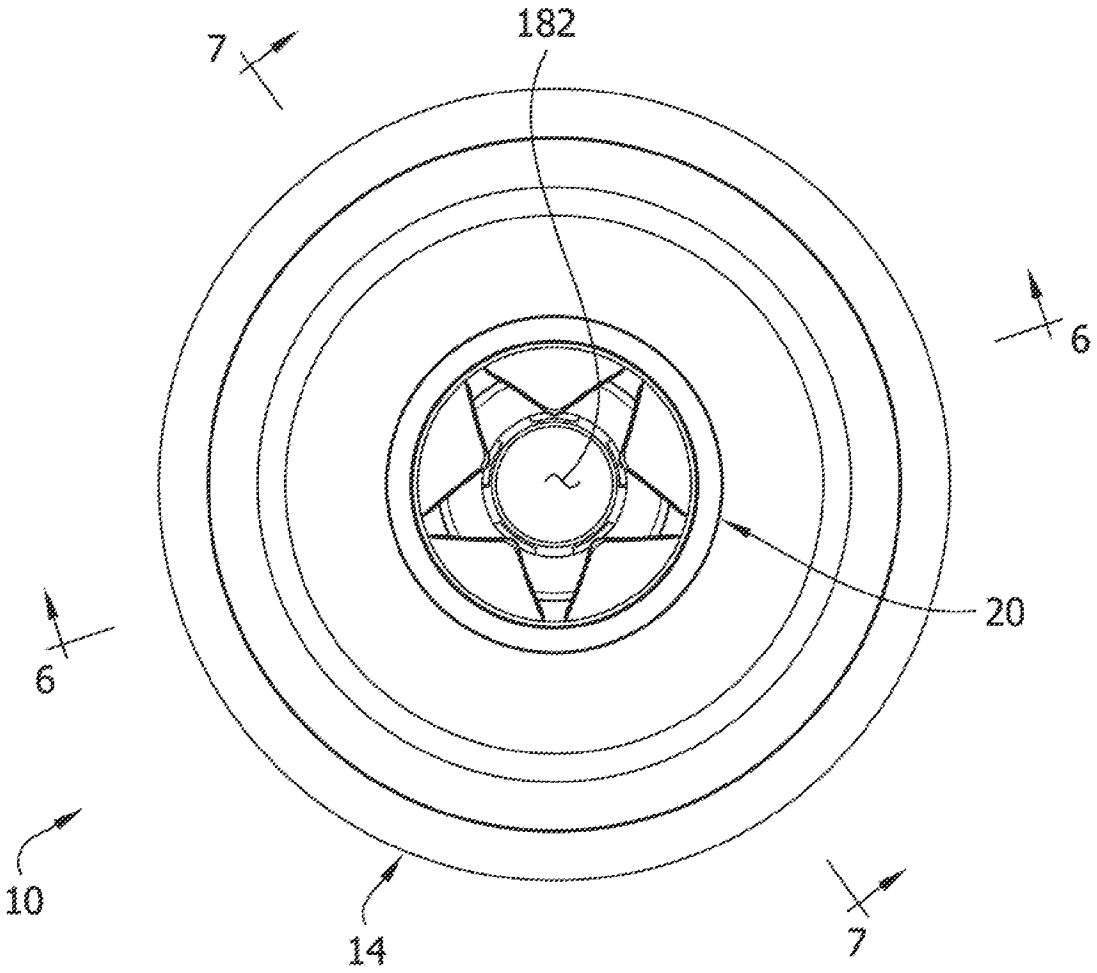
FIG. 3 is a top plan view of the valve.
Figure 4:
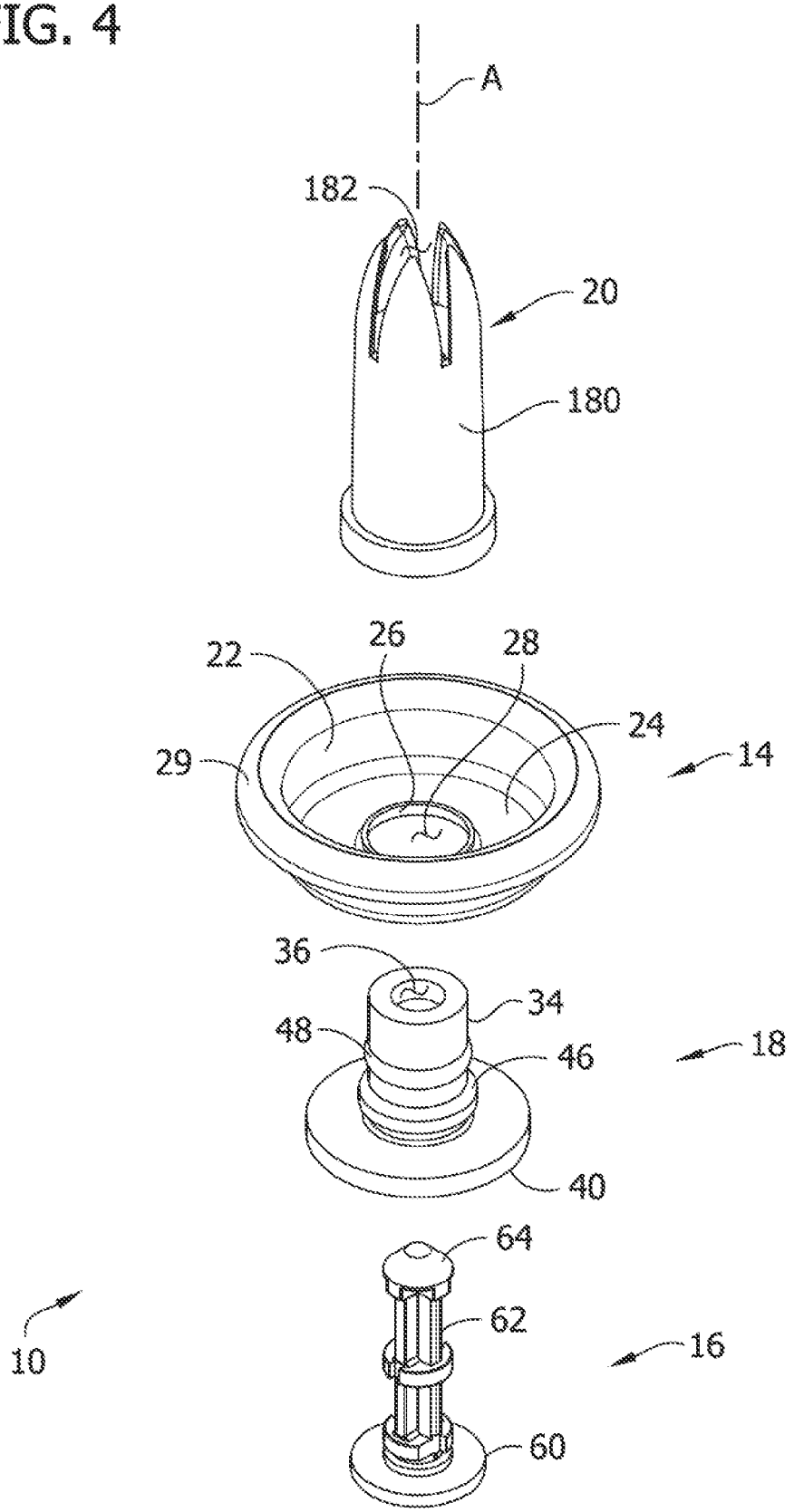
FIG. 4 is an exploded perspective of the valve.

Referring now to FIGS. 1-4, an embodiment of a valve constructed according to the teachings of the present disclosure is generally indicated at reference number 10. As seen in FIG. 4, the valve 10 comprises a mounting cup, generally indicated at 14; a stem, generally indicated at 16; a seal (e.g., a grommet), generally indicated at 18, attached to the stem and disposed between and interconnecting the stem and the mounting cup; and a nozzle (also called an actuator or tip), generally indicated at 20, coupled to the seal. As is known to those skilled in the art, the illustrated valve 10 is suitable for attachment to a pressurized container 20 (e.g., an aerosol container), or other container, for dispensing flowable product contained within the container. As will be explained in more detail below, each of the stem 16 and the nozzle 20 are configured to retard the flow of product therethrough, although in another embodiment one of the stem 16 and the nozzle 20 may be replaced by a conventional component. The orientation of the valve 10 in the drawings provides a point of reference for the terms in this detailed description defining relative locations and positions of structures and components of the valve, including but not limited to the terms "upper," "lower," "top," and "bottom," "upward," and "downward," as used throughout the present disclosure. Relative orientations may change depending on how the valve is used.

Figure 6:
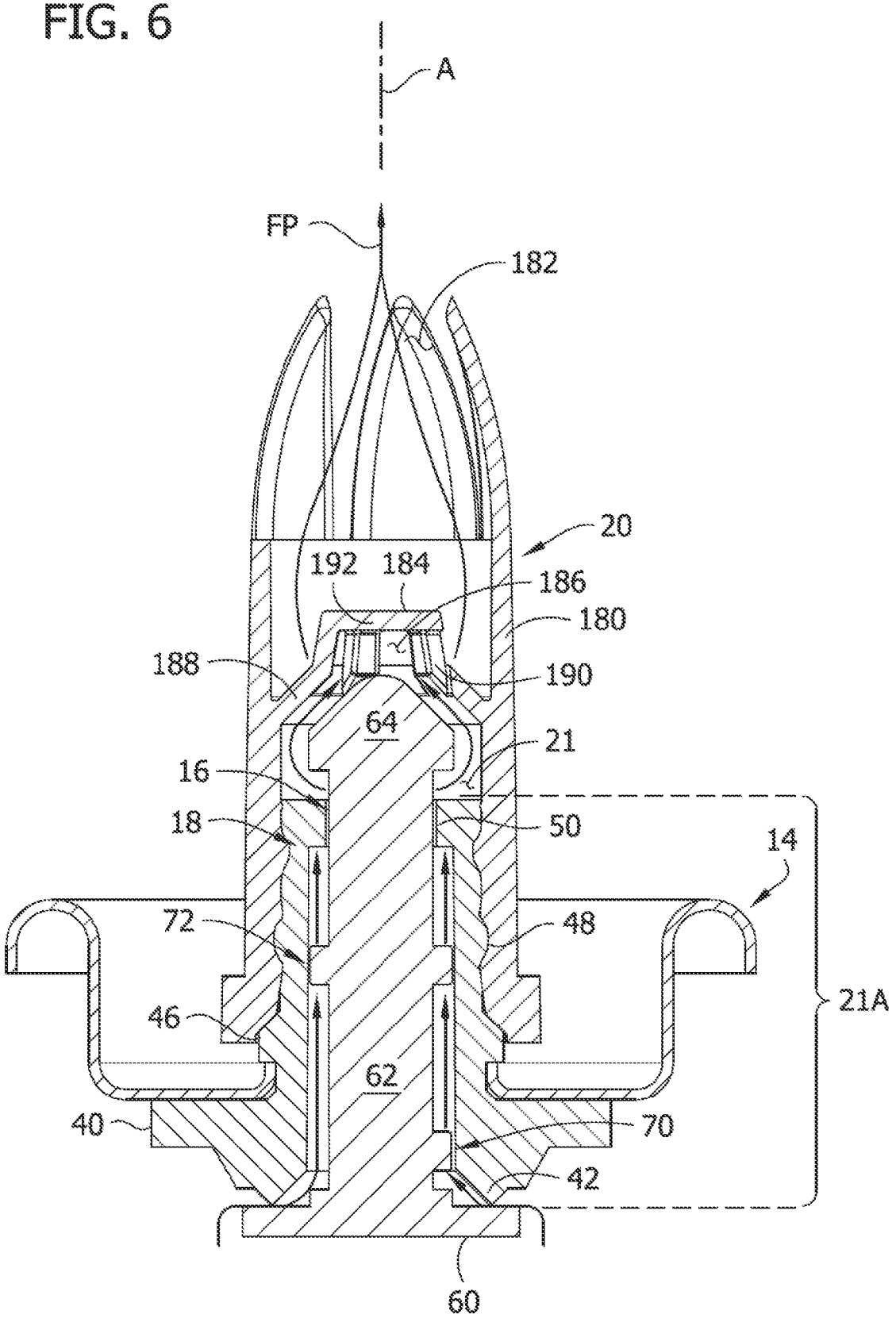
FIG. 6 is a cross-section taken in the plane of line 6-6 of FIG. 3.
Figure 7:
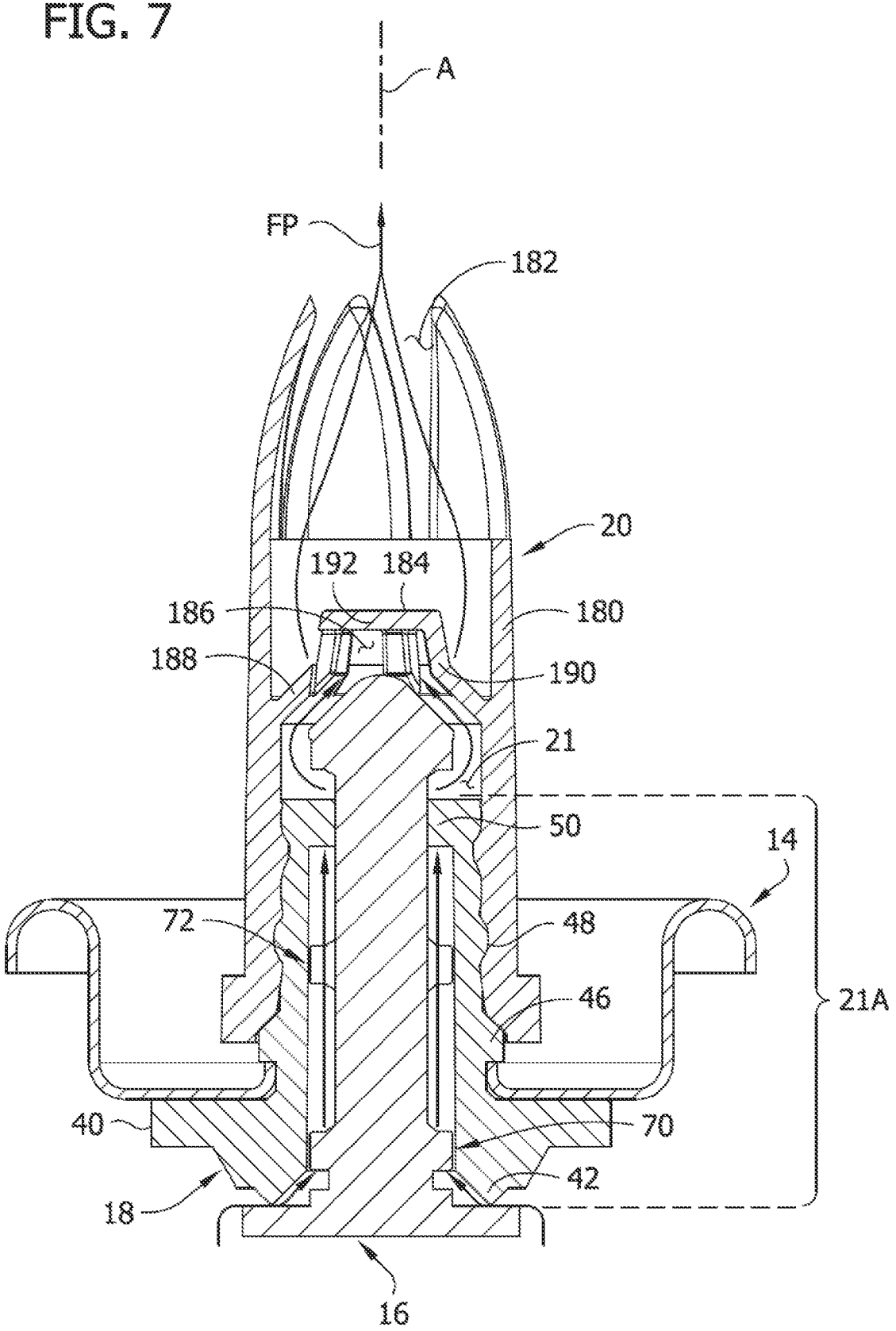
FIG. 7 is a cross-section taken in the plane of line 7-7 of FIG. 3.

As shown in FIGS. 6 and 7, the valve 10 has a valve passage 21 that extends generally along a valve axis VA. The valve 10 is a normally open valve. In the illustrated embodiment, the valve 10 is configured to be opened by tilting the upper portion of the valve in relation to the container (e.g., the illustrated valve is a tilt valve). In one or more additional embodiments within the scope of this disclosure, the valve may also comprise a vertically actuated valve. When the valve 10 is open, the valve passage 21 is configured so that product in the container is passable through the valve passage along a flow path FP to discharge the product from the container. For example, in an exemplary embodiment, the valve 10 is mounted on a whipped cream canister (broadly, a pressurized container having aerated flowable product therein). Thus, when the valve 10 is open, pressurized gas in the canister causes the whipped cream (broadly, aerated flowable product) to be imparted through the valve passage 21 along the flow path FP, thus discharging or dispensing whipped cream from the container.

In general, the mounting cup 14 is configured to mount the valve 10 on the container. As shown in FIG. 4, the mounting cup 14, which may be formed from a piece of metal (e.g., tin plate steel, stainless steel or aluminum), has a generally cylindrical sidewall 22. As described in U.S. Patent Application Publication No. 2016/0009482, which is hereby incorporated by reference in its entirety, the valve 10 may be attached to the container by deforming the mounting cup so that a portion of the sidewall 22 bulges radially outward to underlie a shoulder of the container. The mounting cup 14 further includes a bottom wall 24, extending radially inward with respect to the valve axis A from adjacent a lower end of the sidewall 22. A central portion 26 of the bottom wall 24 defines a cylindrical opening 28, also known as a pierce hole or mounting hole, through which the seal 18 and the stem 16 extend. In the illustrated embodiment, the central portion 26 of the bottom wall 24 extends upward to define a collar or ferrule surrounding the seal 18. The opening 28 has an axial length extending between open upper and lower ends of the ferrule 26. In other embodiments, the central portion 26 may not extend upward to define a collar or ferrule. Instead, the central portion 26 may be substantially planar and the opening 28 may extend therethrough and have an axial length corresponding to the thickness of the central portion. The mounting cup 14 is configured for reception into an opening of the container, such as an opening in a top of the container or a bottom of the container. An upper curled lip 29 at an upper end of the sidewall 22 mates with the bead (curl) of the container. The valve 10 is then secured to the container by crimping (clinching) the curled lip 29 onto the bead. The mounting cup 14 may be of other deigns and configurations without departing from the scope of the present disclosure.

Referring to FIGS. 4 and 6, the seal 18 has a lower end portion (which also may be referred to as an inner end portion or an upstream end portion, or more broadly, a first end portion) and an upper end portion (which also may be referred to as an outer end portion or a downstream end portion, or more broadly, a second end portion) spaced apart along the valve axis A. The seal 18 has a generally annular shape from the lower end portion to the upper end portion. A radially outer surface of the seal is sealed to the mounting cup to prevent product from passing through an interface between the mounting cup and the seal, and an inner surface of the seal defines an open-ended lumen 36 (FIG. 4) along the valve axis A. That is, the lumen 36 extends along the axis A from the lower end portion through the upper end portion of the seal 18. The lumen is configured to receive a longitudinal segment of the valve stem 16 therein such that the inner surface of the seal and an outer surface of the stem define a generally annular passage section 21A (FIG. 6) of the valve passage 21, which extends radially between the valve stem and the seal. The inner surface of the seal 18 extends circumferentially around the generally annular passage section. In the illustrated embodiment, the lumen 36 is generally centered on the valve axis VA such that the inner surface of the seal 18 extends circumferentially 360° about the valve axis.

The seal 18 comprises an elongate neck 34 that defines the upper end portion of the seal. A flange 40 extends radially outward from the lower end of the neck, and a lower external seal bead 46 extends radially outward from the neck at a location spaced apart along the valve axis A from the flange. The lower external annular seal bead 46 engages an upper peripheral edge of the ferrule 26 of the mounting cup 14 and the flange 40 engages the bottom wall 24 of the mounting cup to secure the seal 18 to the mounting cup. In the illustrated embodiment, the elongate neck 34 further comprises an upper external seal bead 48. In one or more embodiments, the neck 34 can be configured to be pressed into the nozzle 20, whereby the seal 18 is coupled to the nozzle by interference fit at the upper external seal bead 48. In certain embodiments, the nozzle 20 can comprise an internal annular recess that is configured to receive the upper external seal bead 48 to form an interlocking fit between the seal 18 and the nozzle.

As shown in FIG. 6, a valve seat 42 is formed on a lower end of the flange 40. The valve seat 42 is configured to sealingly engage a lower end portion of the valve stem 16 to close the valve 10 until the valve is opened. That is, when the valve 10 is in its normally closed configuration, the valve seat 42 is configured to sealingly engage the valve stem 16 to prevent product from passing through an interface between the valve stem and the seal 18.

The illustrated seal 18 further comprises an inner lip or baffle 50 at the upper end portion of the neck 34. The inner lip 50 extends radially inward from the upper end portion of the neck 34, toward the valve stem 16. As will be explained in further detail below, the inner lip is configured to define one of several (e.g., three or more, or four in the illustrated embodiment) discrete flow restrictions along the valve passage 21 at spaced apart locations along the valve axis, for retarding the flow of product through the valve 10. In the illustrated embodiment, the inner lip 50 has a radially inner margin that opposes and contacts circumferentially spaced apart circumferential segments of the valve stem 16. The seal 18 may be of other deigns and configurations without departing from the scope of the present disclosure.

Figure 5:
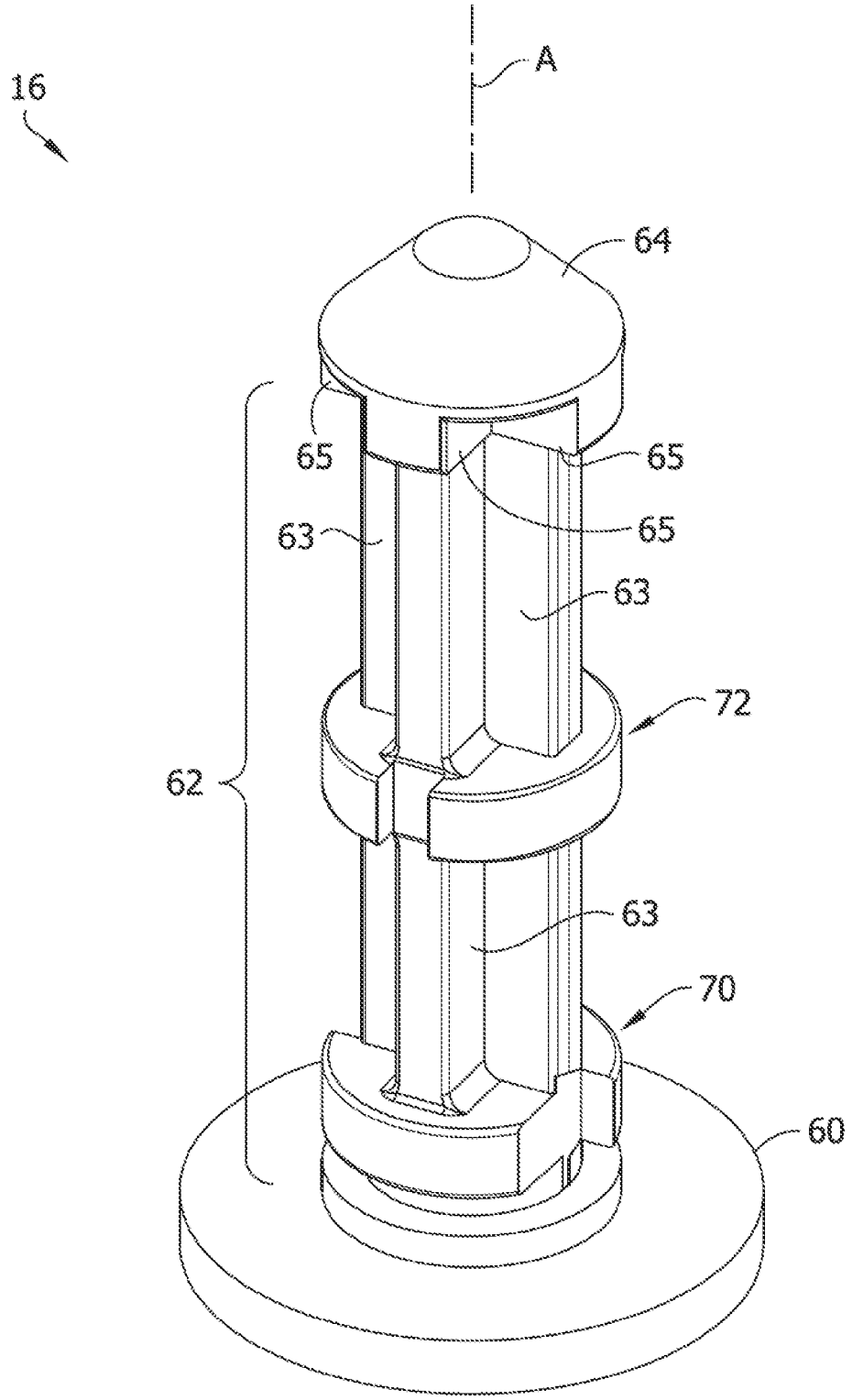
FIG. 5 is a perspective of a stem of the valve.

Referring to FIG. 5, the illustrated valve stem 16 has a lower end portion (which also may be referred to as an inner end portion or an upstream end portion, or more broadly, a first end portion) and an upper end portion (which also may be referred to as an outer end portion or a downstream end portion, or more broadly, a second end portion) spaced apart along the valve axis A. A disc 60 defines the lower end portion of the valve stem 16 and a stem body 62 extends along the valve axis A from the disc 62 toward the upper end portion of the valve stem. In the illustrated embodiment, the stem body 62 has a generally cruciform cross-sectional shape. That is, the illustrate stem body 62 includes four perpendicularly disposed longitudinal splines 63 that meet at a central region of the stem body 62. In the illustrated embodiment, the central region is coaxial with the valve axis A such that the walls 63 extend radially outward relative to the valve axis in generally perpendicular directions. An enlarged head 64 is formed on an upper end portion of the stem body 62. The head 64 is radially enlarged in relation to the stem body 62 (e.g., protrudes radially outward of the splines 63 with respect to the valve axis A. In the illustrated embodiment, an upper end portion of the head 64 has a generally conical shape, and a lower end portion of the head has a cruciform cross-sectional shape including feet portions 65 that are circumferentially aligned with the wall portions 63.

In the illustrated embodiment, the stem 16 is devoid of an inner fluid passage (e.g., the entire cross-section of the stem 16 is occupied by the rigid material forming the stem). Those skilled in the art will appreciate that stem bodies comprising inner passages are conventional in tilt valves of this type. It is contemplated that certain embodiments within the scope of this disclosure may be configured to direct product through a central or inner longitudinal passage of a stem. Moreover, the features (e.g., baffles) described below for retarding the flow of product imparted through the valve may be adapted for use along an inner longitudinal passage of a valve stem in one or more embodiments. But in the illustrated embodiment, the valve 10 is configured to direct the product discharged from the container to flow along the exterior of the stem 16 instead of through an internal fluid passage.

As shown in FIGS. 6 and 7, the stem 16 is configured to be received in the lumen 36 of the seal 18 such that the upper side of the disc 60 is engaged with the valve seat 42. The stem body 62 extends upward from the disc 60 along the valve axis A through the lumen 36 of the seal 18, and the head 64 protrudes upward along the axis from the upper end of the seal. The stem 16 is received in the seal 18 such that the radially outer surface of the stem body 62 and the radially inner surface of the seal define the generally annular passage section 21A of the valve passage 21. The interface between the disc 60 and the valve seat 42 is configured to define an inlet to the valve passage 21 when the valve 10 is open. To open the valve 10, the user presses the nozzle 20 laterally, which tilts the rigid valve stem 16 and deflects the flexible seal 18. As a result, part of the disc 60 moves away from the valve seat 42 to open the interface between the disc and the valve seat. As indicated by the arrows in FIGS. 6 and 7 representing the flow path FP, the pressurized product in the container can then enter the valve passage 21 through the inlet and flow upward along the generally annular segment 21A of the flow path.

Referring to FIGS. 5-9, the illustrated valve stem 16 comprises lower and upper (broadly, first and second) baffles, generally indicated at 70 and 72, respectively. The baffles 70, 72 extend radially outward from the stem body 62 at longitudinally spaced locations along the stem body to define respective flow restrictions along the generally annular passage section 21A of the valve passage 21. In the illustrated embodiment, the valve stem 16 has two baffles 70, 72 for defining two spaced apart flow restrictions along the generally annular passage section. However, it will be understood that other valve stems can have other numbers (e.g., one or more) baffles for defining other numbers of flow restrictions along a valve passage. Generally speaking, each baffle 70, 72 comprises a transverse or radial wall that extends radially outward from the stem body 62 at a respective location spaced apart along the valve axis between the disc 60 and the head 64.

Figure 8:
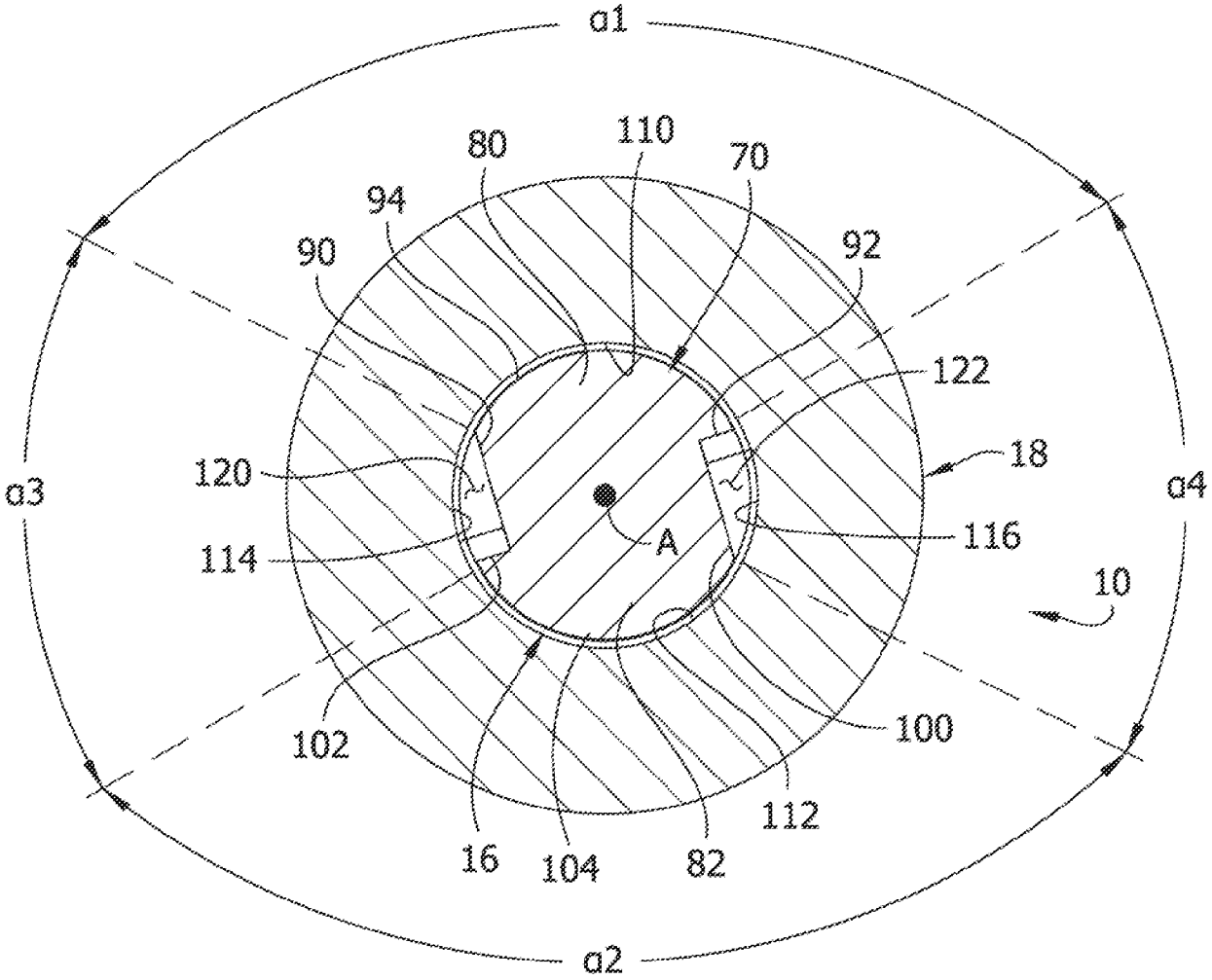
FIG. 8 is a cross-section taken in the plane of line 8-8 of FIG. 2.

Referring to FIG. 8, in the illustrated embodiment, the lower baffle 70 has first wall portion 80 and a second wall portion 82 generally diametrically opposite the first wall portion with respect to the valve axis A. The first wall portion 80 has a first circumferential side 90, a second circumferential side 92, and a radially outer edge margin 94 extending circumferentially from a radially outer end of the first circumferential side to a radially outer end of the second circumferential side. The second wall portion 82 likewise has a first circumferential side 100, a second circumferential side 102, and a radially outer edge margin 104 extending from an outer end of the respective first circumferential side to an outer end of the respective second circumferential side. The radially outer edge margin 94 of the first wall portion 80 opposes a first circumferential segment 110 of the inner surface of the seal, and the radially outer edge margin 104 of the second wall portion 82 opposes a second circumferential segment 112 of the inner surface of the seal. In certain embodiments, the radially outer edge margins 94, 104 can engage the inner surface of the seal 18 along the respective circumferential segments 110, 112. In other embodiments, the radially outer edge margins 94, 104 can be spaced apart from the respective circumferential segments 110 by only a very small radial dimension (e.g., a maximum radial dimension of less than 0.5 mm, less than 0.4 mm, less than 0.3 mm, less than 0.2 mm, less than 0.1 mm).

The first circumferential side 90 of the first wall portion 80 of the baffle 70, the second circumferential side 102 of the wall second portion 82 of the baffle, and a third circumferential segment 114 of the inner surface of the seal 18, located circumferentially between the first circumferential side of the first wall portion and the second circumferential side of the second wall portion of the baffle, define a first restricted opening 120 through which product is passable along the valve axis A across the baffle. Similarly, the first circumferential side 100 of the second portion 82 of the baffle 70, the second circumferential side 100 of the first portion 80 of the baffle, and a fourth circumferential segment 116 of the seal inner surface, located circumferentially between the first circumferential side of the second wall portion and the second circumferential side of the first wall portion, define a second restricted opening 122 through which product is passable along the valve axis A across the baffle.

Accordingly, each of the restricted openings 120, 122 has the form of a notch in the edge margin of an otherwise circular peripheral edge margin of the baffle 70. In the illustrated embodiment, the notches are defined by two perpendicular surfaces that intersect the perimeter of an imaginary circle that can be superimposed onto the radially outer edge margins 94, 104. Each respective first circumferential side 90, 100 defining part of one of the restricted openings 120, 122 is generally contiguous and coplanar with a radially outer face of one of the splines 63. Thus, the radially outer faces of respective splines 63 define respective portions of the restricted openings 120, 122 in the illustrated embodiment. Each respective second circumferential side 92, 102 is generally aligned with a generally radially extending side of a respective one of the splines 63 but faces in an opposing direction. Thus, the restricted openings 120, 122 are circumferentially aligned with opposing splines 63 of the stem body in the illustrated embodiment.

Figure 11:
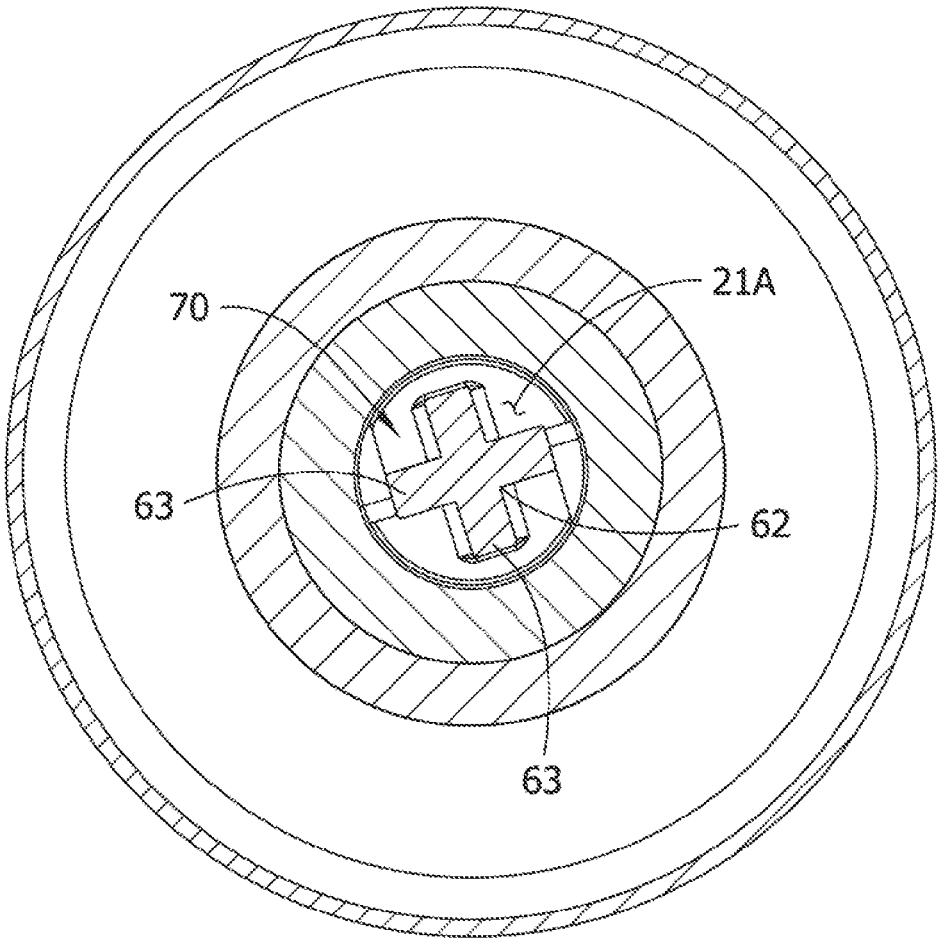
FIG. 11 is a cross-section taken in the plane of line 11-11 of FIG. 2.

As can be seen, the valve 10 is configured to direct most or substantially all (e.g., more than 90%, more than 95%) of the product which flows longitudinally across the baffle 70 to flow through the restricted openings 120, 122. Moreover, in one or more embodiments, the combined cross-sectional area (in a plane perpendicular to the valve axis) of the restricted openings 120, 122 is substantially less than the maximum cross-sectional area of the generally annular passage section 21A, shown in FIG. 11. For example, in an exemplary embodiment, the generally annular passage section 21A has a maximum cross-sectional area (in a plane perpendicular to the valve axis A) at the location of the cross-section shown in FIG. 11 (e.g., along a longitudinal section of the stem body 62 devoid of baffles). In the illustrated embodiment, the maximum cross-sectional area of the annular passage section 21A is thus defined as the cross-sectional area in a radial plane between the exterior of the cruciform stem body 62 and the inner surface of the seal 18. In one or more embodiments, the restricted openings 120, 122 defined by the baffle 70 have a combined cross-sectional area that is less than 25% of this maximum cross-sectional area. Thus, the baffle 70 forms a flow restriction along the generally annular passage section 21A of the valve passage. The flow restriction retards the flowable product as it flows along the flow path FP.

Each of the first circumferential segment 110, the second circumferential segment 112, the third circumferential segment 114, and the fourth circumferential segment 116, has a respective arc angle $\alpha1$, $\alpha2$, $\alpha3$, $\alpha4$ with respect to the valve axis A. In the illustrated embodiment, the arc angles $\alpha1$, $\alpha2$ are about the same and the arc angles $\alpha3$, $\alpha4$ are about the same. In one or more embodiments, the arc angles $\alpha1$, $\alpha2$ are greater than the arc angles $\alpha3$, $\alpha4$. In the illustrated embodiment, the arc angles $\alpha3$, $\alpha4$ are less than 90 degrees and the arc angles $\alpha1$, $\alpha2$ are greater than 90 degrees. For example, in an exemplary embodiment, each of the arc angles $\alpha1$, $\alpha2$ is in an inclusive range of from about 100° to about 170° (e.g., an inclusive range of from about 110° to about 150°), and each of the arc angles $\alpha3$, $\alpha4$ is in an inclusive range of from about 10° to about 80° (e.g., an inclusive range of from about 30° to about 70°). However, in other embodiments it will be understood that the respective circumferential segments of the inner surface of the seal could have other angles.

Figure 9:
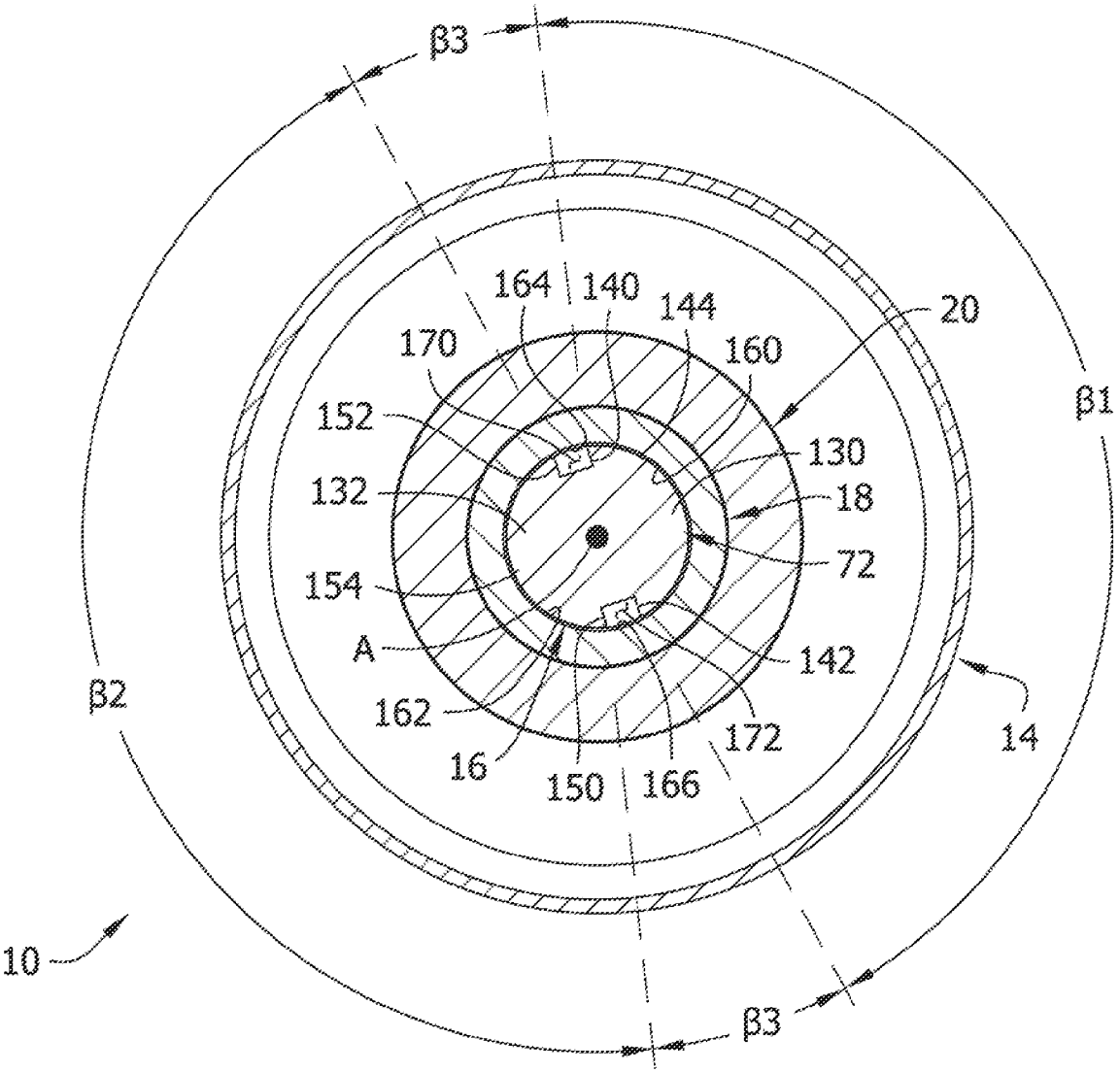
FIG. 9 is a cross-section taken in the plane of line 9-9 of FIG. 2.

Referring to FIG. 9, like the lower baffle 70, the upper baffle 72 has a first wall portion 130 and a second wall portion 132 generally diametrically opposite the first wall portion with respect to the valve axis A. The first wall portion 130 has a first circumferential side 140, a second circumferential side 142, and a radially outer edge margin 144 extending circumferentially from a radially outer end of the first circumferential side to a radially outer end of the second circumferential side. The second wall portion 132 likewise has a first circumferential side 150, a second circumferential side 263, and a radially outer edge margin 154 extending circumferentially from an outer end of the respective first circumferential side to an outer end of the respective second circumferential side. The radially outer edge margin 144 of the first wall portion 130 opposes a first circumferential segment 160 of the inner surface of the seal, and the radially outer edge margin 154 of the second wall portion 132 opposes a second circumferential segment 162 of the inner surface of the seal. Like the radially outer edge margins 94, 104 of the lower baffle 70, the radially outer edge margins 144, 154 of the upper baffle 72 can engage the inner surface of the seal 18 along the respective circumferential segments 160, 162 or be spaced apart from the respective circumferential segments by only a very small radial dimension (e.g., a maximum radial dimension of less than 0.5 mm, less than 0.4 mm, less than 0.3 mm, less than 0.2 mm, less than 0.1 mm).

The first circumferential side 140 of the first wall portion 130 of the baffle 72, the second circumferential side 152 of the second wall portion 132 of the baffle, and a third circumferential segment 164 of the inner surface of the seal 18, located circumferentially between the first circumferential side of the first wall portion and the second circumferential side of the second wall portion of the baffle, define a first restricted opening 170 through which product is passable along the valve axis A across the upper baffle. Similarly, the first circumferential side 150 of the second wall portion 132 of the baffle 72, the second circumferential side 150 of the first wall portion 130 of the baffle, and a fourth circumferential segment 166 of the inner surface of the seal 18, located circumferentially between the first circumferential side of the second wall portion and the second circumferential side of the first wall portion, define a second restricted opening 172 through which product is passable along the valve axis A across the baffle.

Accordingly, each of the restricted openings 170, 172, like the restricted openings 120, 122, has the form of a notch in the edge margin of an otherwise circular peripheral edge margin of the baffle 72. But unlike the restricted openings 120, 122, the notches in the upper baffle 72 which form the restricted openings 170, 172 are defined by three generally perpendicular surfaces. A radially inner end of each restricted opening 170, 172 is defined by a radially outer face of one of the splines 63. In this case, two different splines than the splines that define portions of the lower restricted openings 120, 122 form inner ends of the restricted openings 170, 172. And as explained above, opposite first and second circumferential sides of each opening 120, 122, are defined by a respective pair of the circumferential sides 140, 142, 150, 152 of the wall portions 130, 132. These opposite circumferential sides are generally aligned with the opposing sides of the spline 163 which defines the inner end of the respective restricted opening 170, 172, but each side defining the restricted opening 170, 172 faces in an opposite direction from the corresponding side of spline. The opposite circumferential sides of the restricted openings 170, 172 intersect the perimeter of an imaginary circle that can be superimposed onto the radially outer edge margins 144, 154. Thus, in the illustrated embodiment, the lower restricted openings 120, 122 are generally aligned with first and second splines 63 on opposite sides of the valve axis A, and the upper restricted openings 170, 172 are aligned with third and fourth splines 63 on opposite sides of the valve axis.

The valve 10 is configured to direct most or substantially all (e.g., more than 90%, more than 95%) of the product which flows longitudinally across the upper baffle 72 to flow through the restricted openings 170, 172. Moreover, in one or more embodiments, the combined cross-sectional area (in a plane perpendicular to the valve axis) of the restricted openings 170, 172 is substantially less than the maximum cross-sectional area of the generally annular passage section 21A, shown in FIG. 11, e.g., less than 25% of this maximum cross-sectional area. Thus, the baffle 70 forms a flow restriction along the generally annular passage section 21A of the valve passage. The flow restriction retards the flowable product as it flows along the flow path FP.

Each of the first circumferential segment 160, the second circumferential segment 162, the third circumferential segment 164, and the fourth circumferential segment 166, has a respective arc angle β1, β2, β3, β4 with respect to the valve axis A. In the illustrated embodiment, the arc angles β1, β2 are about the same and the arc angles β3, β4 are about the same. In one or more embodiments, the arc angles β1, β2 are greater than the arc angles β3, β4. In the illustrated embodiment, the arc angles β3, β4 are less than 90 degrees and the arc angles β1, β2 are greater than 90 degrees. For example, in an exemplary embodiment, each of the arc angles β1, β2 is in an inclusive range of from about 100° to about 170° (e.g., an inclusive range of from about 150° to about 170°), and each of the arc angles β3, β4 is in an inclusive range of from about 10° to about 80° (e.g., an inclusive range of from about 10° to about 30°). However, in other embodiments it will be understood that the respective circumferential segments of the inner surface of the seal could have other angles.

FIGS. 8 and 9 show the valve 10 in the same orientation. As is apparent by comparison of FIGS. 8 and 9, the restricted openings 170, 172 defined by the upper baffle 72 (FIG. 9) are circumferentially offset with respect to the restricted openings 120, 122 defined by the lower baffle 70 (FIG. 8). Whereas in FIG. 9 the upper restricted openings 170, 172 are centered on about the eleven-o'clock and five-o'clock circumferential positions about the axis A, in FIG. 8 the restricted openings 120, 122 are centered on about the eight-o'clock and two-o'clock positions. The circumferential offset between the lower restricted openings 120, 122 and the upper restricted openings 170, 172 is thought to cause product flowing along the valve passage 21 to tend to swirl or flow in a somewhat circumferential direction relative to the valve axis A after exiting the lower restricted openings 120, 122 so that it can pass through the circumferentially offset upper restricted openings 170, 172. Moreover, the circumferential movement of the product may be somewhat obstructed by the splines 63 of the cruciform stem body 62, which oppose circumferential flow at locations of the passage section 21A located radially inward of the outer edge margins of the splines (e.g., locations that circumferentially overlap the splines).

As can be seen, each of the upper restricted openings 170, 172 defined by the upper baffle 72 has about the same cross-sectional area, and likewise each of the lower restricted openings 120, 122 defined by the lower baffle 70 has about the same cross-sectional area. In the illustrated embodiment, however, the cross-sectional area of each of the upper restricted openings 170, 172 is less than the cross-sectional area of each of the lower restricted openings 120, 122. Correspondingly, the arc angles β3, β4 of the circumferential segments 164, 166 of the inner surface of the seal 18 that define the respective upper restricted openings 170, 172 are less than the arc angles α3, α4 of the of the circumferential segments 114, 116 of the inner surface of the seal 18 that define the respective upper restricted openings 170, 172. As a result, in the illustrated embodiment, the upper baffle 72 is configured to form a flow restriction that is a greater impediment to product flow than the flow restriction formed by the lower baffle 70. This is thought to sequentially step-down the flow rate and/or pressure of the material flowing along the flow path FP through the valve passage 21.

Figure 13:
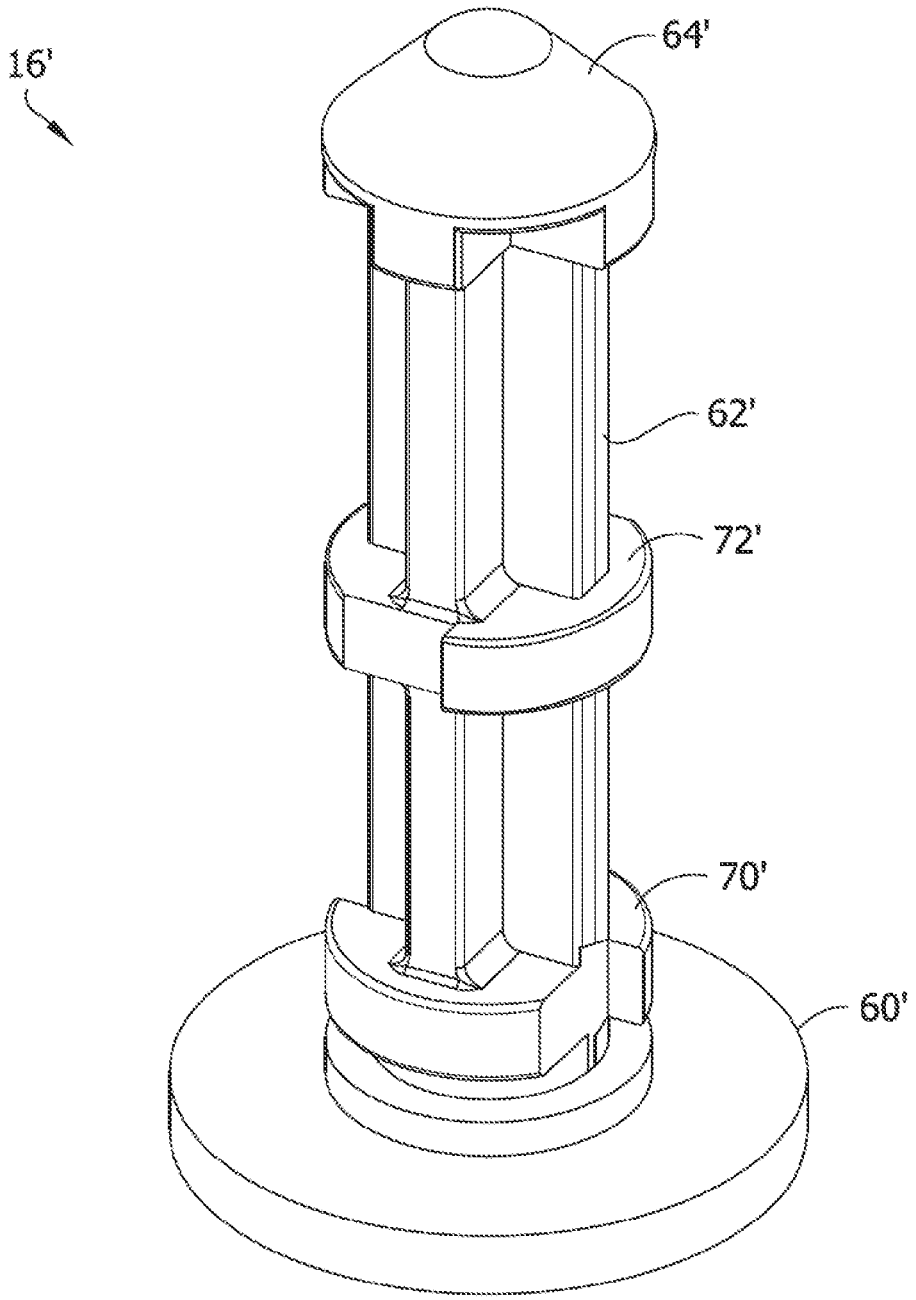
FIG. 13 is a perspective similar to FIG. 4 of another embodiment of a valve stem.
Figure 14:
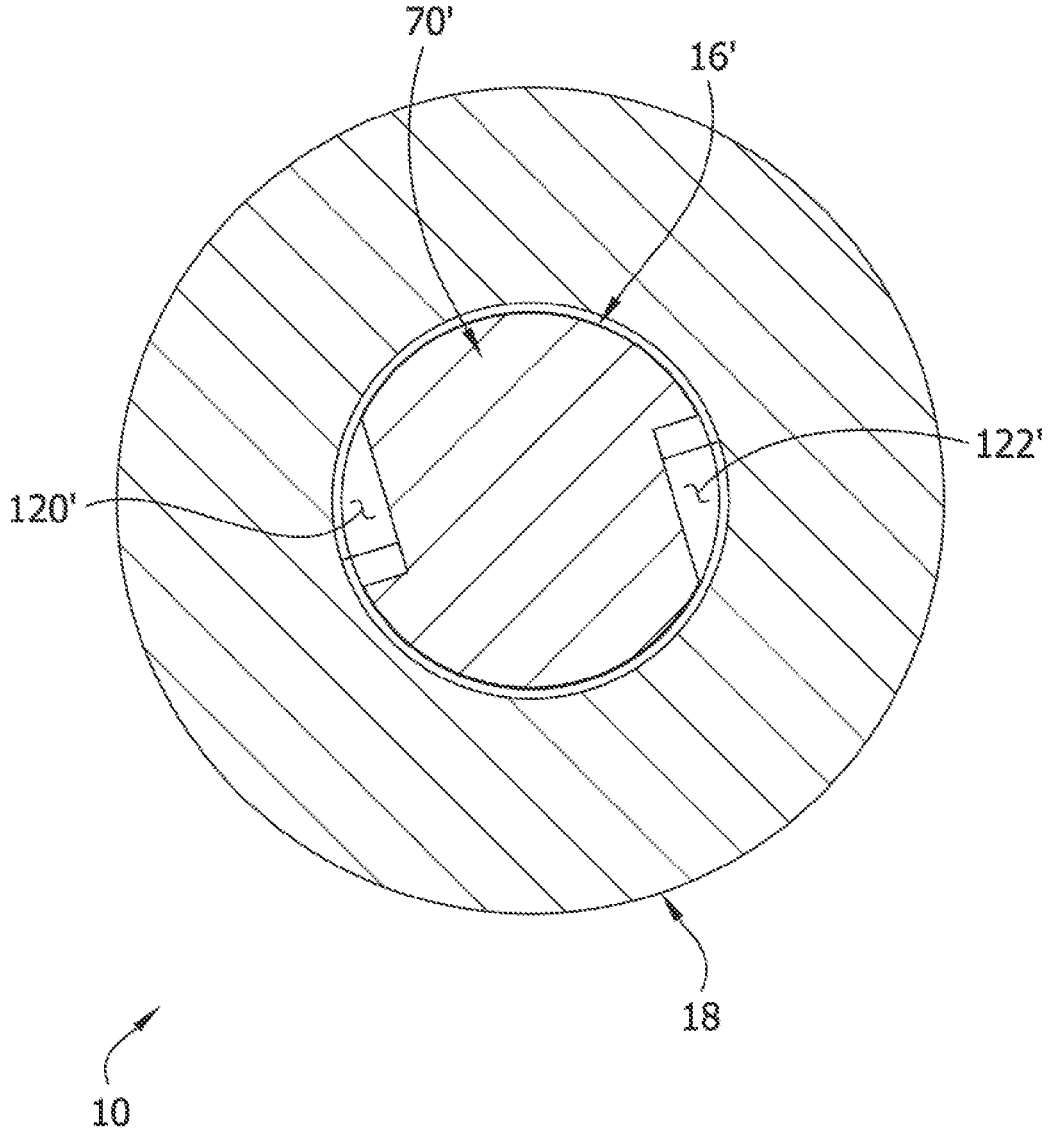
FIG. 14 is a cross-section similar to FIG. 8 wherein the valve stem of FIGS. 1-10 is replaced by the valve stem of FIG. 11.
Figure 15:
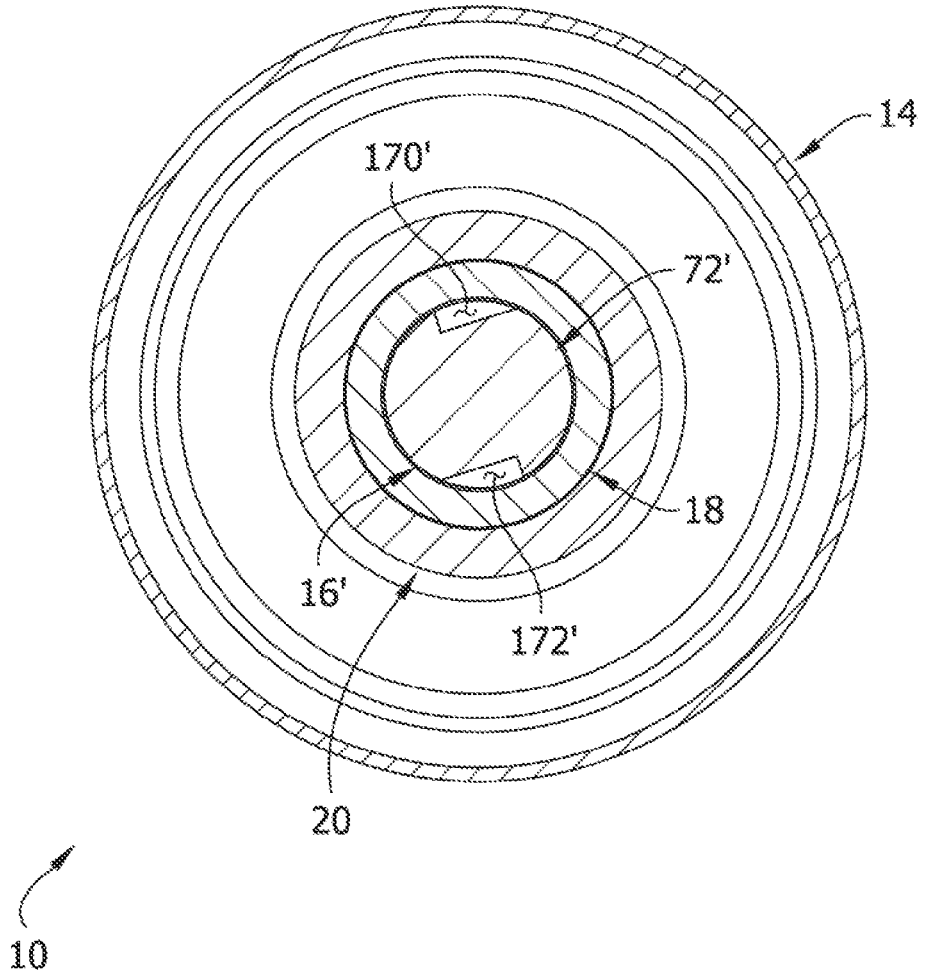
FIG. 15 is a cross-section similar to FIG. 9 wherein the valve stem of FIGS. 1-10 is replaced by the valve stem of FIG. 11.

Although the illustrated embodiment utilizes a lower baffle 70 which allows greater flow through the corresponding flow restriction than the flow restriction formed by the upper baffle 72, it will be understood that other embodiments can have other configurations. For example as shown in FIGS. 13-15, in one or more embodiments, the valve stem 16 of the valve 10 is replaced by a differently configured valve stem, generally indicated at 16'. Except as otherwise mentioned, the valve stem 16' is identical in all material respects to the valve stem 16. Thus, parts of the valve stem 16' that correspond with numbered parts of the valve stem 16 are given the same reference number, followed by a prime symbol. Like the valve stem 16, the valve stem 16' comprises a disc 60' configured to form a seal with the valve seat 42, a generally cruciform stem body 62' that is configured to extend through the lumen 36 of the seal 18 to define a generally annular passage section 21A' that extends radially between the stem body and the inner surface of the seal, and a radially enlarged head 64. Also like the valve stem 16, the valve stem 16' comprises lower and upper baffles 70', 72' that extend radially outward from the stem body 62' at spaced apart locations along the valve axis A. Unlike the baffles 70, 72, however, the lower and upper baffles 70', 72' are substantially the same size and shape. Thus, the baffles 70', 72' define respective restricted openings 120', 122', 170', 172' of substantially the same cross-sectional area. But again, like the restricted openings 120, 122, 170, 172, the lower restricted openings 120', 122', are circumferentially offset from the upper restricted openings 170', 172' about the valve axis A.

Accordingly, it can be seen that, in accordance with one non-limiting aspect of this disclosure, a valve stem can be equipped with one or more radially outwardly extending baffles that each define a flow restriction along an annular passage section of a valve passage between the valve stem and the valve seal. Without being limited to the shapes and arrangements shown and described above, suitable baffles may have one or more wall portions, each with a radially outer edge margin that opposes/and or engages the inner surface of the seal along a respective circumferential segment of the inner surface of the seal (e.g., along a circumferential segment that is less than an entire circumference of the inner surface). Baffles within the scope of this disclosure can have a single wall portion defining a single restricted opening, more than two wall portions defining more than two restricted openings, and/or wall portions of different sizes or shapes to define restricted openings of differing sizes, shapes, or positions that what is illustrated in the drawings. Broadly speaking, in many contemplated embodiments, the radially outer edge margin of a baffle opposes and/or engages the inner surface of the seal along one or more circumferential segments of the inner surface having an arc angle with respect to the valve axis of less than 360°. It is also possible, however, to provide a baffle with a radially outer edge margin that opposes and/or engages the inner surface of a seal about the entire 360-degree circumference, wherein restricted openings are defined through the baffle wall radially inward of the radially outer edge margin.

Figure 12:
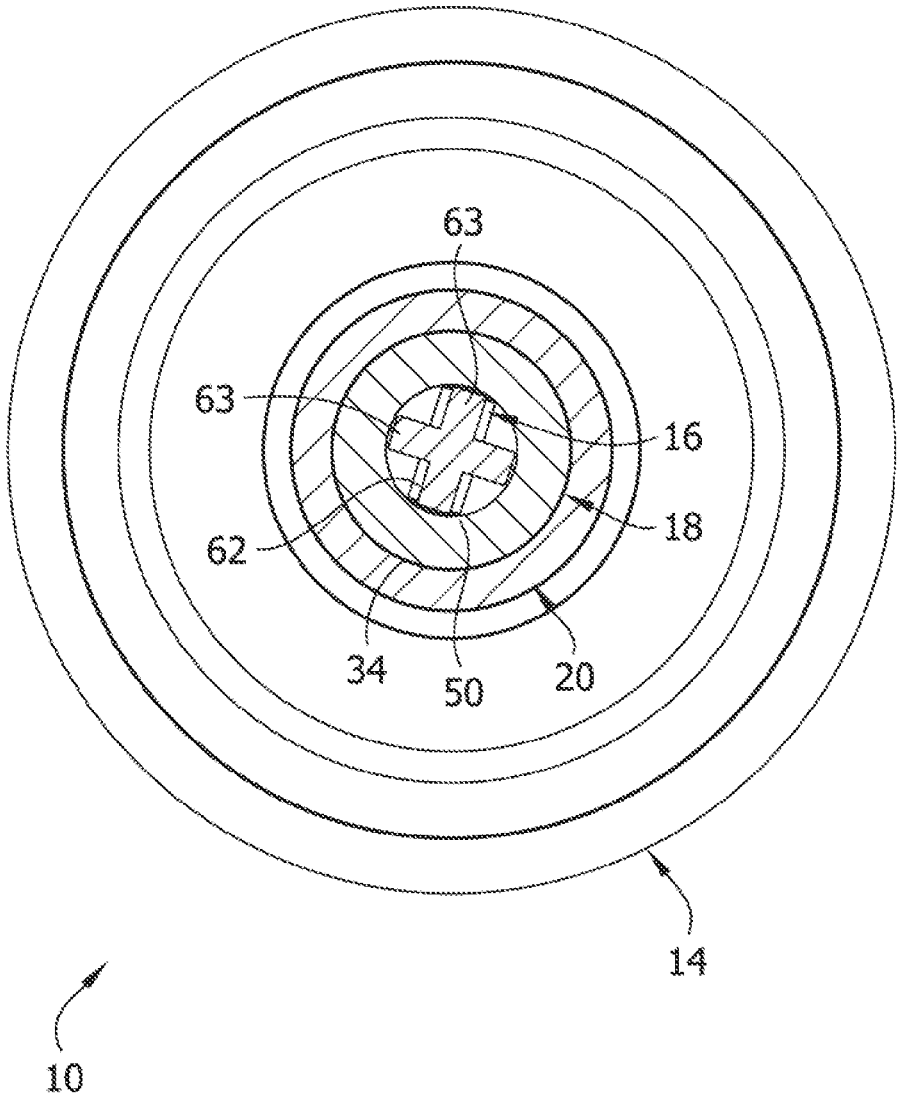
FIG. 12 is a cross-section taken in the plane of line 12-12 of FIG. 2.

Referring to FIG. 12, as mentioned above, in one or more embodiments a (third) flow restriction along the annular passage section 21A of a valve passage 21 that extends radially between the stem 16 and the seal 18 may be defined by an inwardly protruding lip 50 (broadly, a baffle) of the seal. In the illustrated embodiment, the radially inner edge margin of the lip 50 is configured to engage the radially outer face of each of the splines 63 and thereby direct substantially all of the product flowing along the valve passage 21 to flow longitudinally across the lip through the longitudinal recesses located circumferentially between the splines. That is, the lip 50 substantially inhibits the product from flowing radially outward of the splines 63 and thus substantially reduces the cross-sectional area of the passage 21 in comparison with the maximum cross-sectional area depicted in FIG. 11. In one or more embodiments, the cross-sectional flow area at the flow restriction defined by the lip 50 is less than 50% of the maximum cross-sectional flow area of the generally annular passage section 21A shown in FIG. 11.

It can be seen that, in one or more embodiments, the valve 10 may comprise a stem 16 and a seal 18 that define a generally annular passage section 21A radially between them, wherein the passage section has one or more longitudinal sections defining a maximum cross-sectional flow area of the generally annular passage section and a plurality (e.g., at least three) flow restrictions that each define a total cross-sectional flow area that is less than the maximum cross-sectional flow area (e.g., each of the plurality of longitudinally spaced flow restrictions has a total cross-sectional area that is less than 75% of the maximum cross-sectional flow area, less than 60% of the maximum cross-sectional flow area, less than 50% of the maximum cross-sectional flow area, less than 40% of the maximum cross-sectional flow area).

Referring to FIG. 4, the nozzle 20 comprises an annular nozzle body 180 having a lower end portion (which also may be referred to as an inner end portion or an upstream end portion, or more broadly, a first end portion) and an upper end portion (which also may be referred to as an outer end portion or a downstream end portion, or more broadly, a second end portion) spaced apart along the valve axis A. The lower end portion of the nozzle body 180 is configured to be press-fit onto the neck of the seal 34. The upper end portion of the nozzle body 180 defines an outlet 182 through which flowable product can be discharged from the valve 10. In an exemplary embodiment, the nozzle body 180 tapers radially inward toward the upper end portion thereof. As shown, the outlet 182 can comprise a central opening through the upper axial end of the nozzle body 180 and a plurality of circumferentially spaced slots that extend radially outward from the central opening. As is known to those skilled in the art, this type of nozzle outlet 182 can form decorative beads or pipes of flowable product that can hold its shape.

Figure 10:
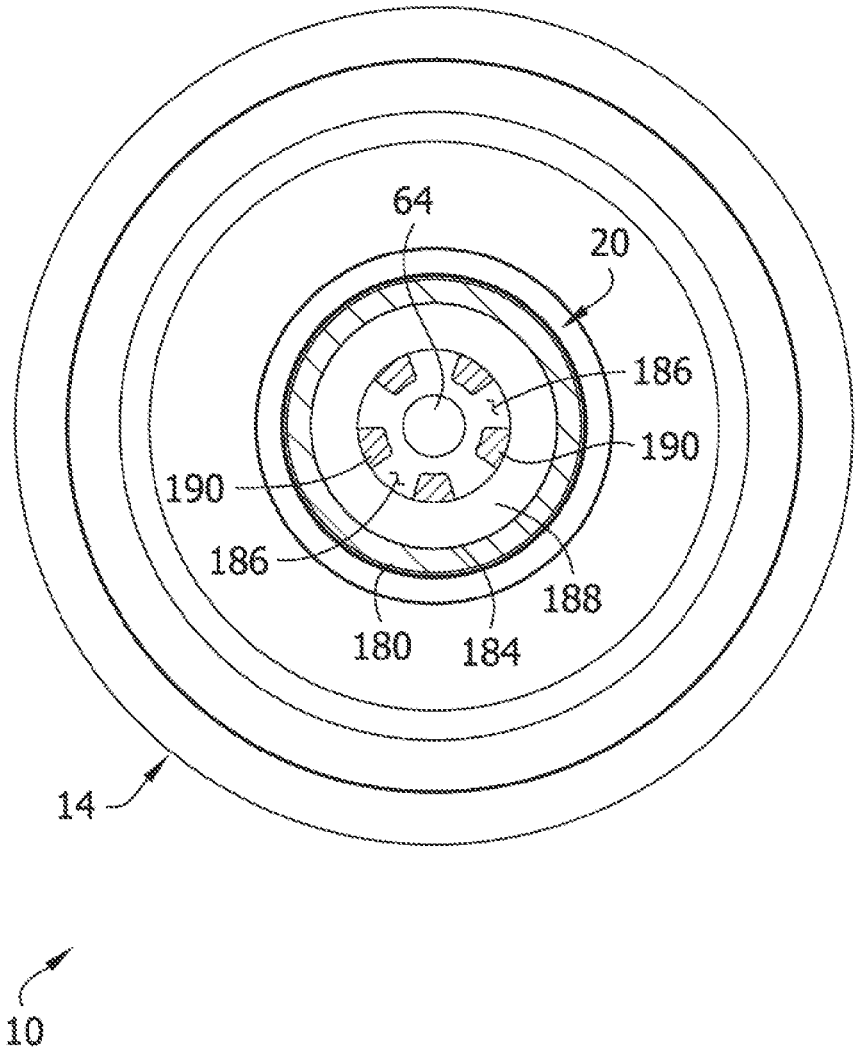
FIG. 10 is a cross-section taken in the plane of line 10-10 of FIG. 2.

Referring to FIGS. 6-7 and 10, the illustrated nozzle 20 further comprises a nozzle baffle 184 spaced apart along the valve axis A between the upper end portion of the stem 16 and the nozzle outlet 182. The nozzle baffle 184 defines a (fourth) flow restriction along the valve passage 21 between generally annular passage segment 21A and the outlet. The nozzle baffle 184 extends generally transverse to the valve axis A and defines a plurality of restricted openings 186. The nozzle baffle 184 is configured to direct all of the flowable product passing through the valve passage 21 to flow through the restricted openings 186 before being discharged from the valve 10. In the illustrated embodiment, the nozzle baffle 184 comprises an outer conical portion 188 that extends generally parallel to the conical upper end of the valve stem head 64. The lower end of the conical portion 188 and the upper end of the valve stem head 64 define a generally conical gap therebetween. The product from the container is directed to flow upward and inward along this gap as it flows along the flow path FP. A plurality of generally axially extending legs 190 extend upward along the axis A from the upper, inner end of the conical portion 188. The legs 190 are circumferentially spaced apart such that the restricted openings 186 are interleaved circumferentially between the legs. Upper end portions of the legs 190 are connected to a generally radially extending end wall 192, configured to block the product from crossing the nozzle baffle 184 through the upper axial end. Instead, the nozzle baffle 180 is configured to direct the product to flow radially through the openings 186 across the baffle. This further retards the flow of the material through the valve passage before it is discharged through the outlet 182.

Accordingly, it can be seen that the valve 10 has features that define four discrete flow restrictions spaced apart along the valve axis to retard flowable product such as whipped cream that is being discharged from a pressurized container. When a user presses laterally or radially on the nozzle 20, the seal 18 deflects and the nozzle and stem 16 tilt. As a result, the disc 60 of the stem 16 is unseated from the valve seat 42 to open the inlet of the valve passage 21. Pressure in the container then drives the flowable product to flow through the inlet into the generally annular passage section 21A. Before the product begins flowing steadily upward along the valve axis A, it encounters the lower baffle 70. As explained above, the baffle 70 creates a first flow restriction. The baffle 70 directs a substantial portion of the product to flow through the restricted openings 120, 122. This may cause at least some of the product to flow radially and circumferentially with respect to valve axis A to reach the restricted openings. After flowing through the lower restricted openings 120, 122, the product flows at a reduced pressure along a longitudinal segment of the generally annular passage section to the upper baffle 72. The upper baffle 72 forms a second flow restriction that directs a substantial portion of the product to flow through the restricted openings 170, 172. Because the upper restricted openings 170, 172, are circumferentially offset from the lower restricted openings 120, 1222, at least some of the product will be directed to flow in a circumferential direction about the valve axis A as it flows axially along the longitudinal segment of the stem body 62 between the two baffles. After flowing through the upper restricted openings 170, 172, the product flows at a reduced pressure along a longitudinal segment of the generally annular passage section to the lip 50 of the seal 18. The lip 50 forms a third flow restriction that directs some of the product to flow radially inward into the circumferential regions circumferentially between the splines 63. The product in these regions can travel longitudinally across the lip 50. After flowing past the lip 50, the enlarged head 64 of the valve stem 64 causes the product to travel radially outward along the lower side of the head before traveling generally along the axis A upward along a portion of the valve passage defined between the head and the nozzle 20. In the illustrated embodiment, the product travels upward and radially inward with respect to the valve axis A along the conical portion of the passage 21 defined between the upper end of the stem head 64 and the conical portion 188 of the nozzle baffle. The nozzle baffle 180 forms a fourth flow restriction that directs product to flow radially outward through the restricted openings 186 between the legs 190 of the nozzle baffle before flowing through the upper end portion of the nozzle 20 and out the outlet 182.

As can be seen, the valve 10 defines a tortuous flow path that forces the flowable product to flow radially and circumferentially, as well as longitudinally, before being discharged from the valve. This tortuous flow path is believed to retard the flow of the material along the valve passage. In the case of an aerated flowable product such as whipped cream, this is thought to minimize splattering as the product is discharged.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. A valve for dispensing flowable product from a container, the valve having an upstream end and a downstream end, whereby when the valve is attached to the container and opened, the flowable product is dispensed through the valve in an upstream-to-downstream direction, the valve comprising:

a mounting cup for mounting the valve on the container;

a seal supported on the mounting cup, the seal having an interior surface defining a passage having a longitudinal axis extending in the upstream-to-downstream direction, and a valve seat at an upstream end of the seal; and a valve stem including a stem body having a longitudinal axis extending longitudinally within the passage of the seal, wherein at least a longitudinal portion of the stem body is free from engagement with the interior surface of the seal to define an annular longitudinal passage section therebetween, an upstream portion at an upstream end of the stem body and configured to sealingly engage the valve seat of the seal to inhibit flowable product from flowing into the annular longitudinal portion section, and a baffle extending radially outward from the stem body at a location downstream of the upstream portion of the valve stem, wherein a radially outer edge margin of the baffle engages the interior surface of the seal at a location downstream of the valve seat to restrict flow of the flowable product between the radially outer edge margin of the baffle and the interior surface of the seal, wherein the baffle defines an opening extending longitudinally therethrough in communication with the annular longitudinal passage section.

2. The valve as set forth in claim 1, wherein the annular longitudinal passage section includes first and second annular longitudinal passage sections, wherein the baffle is disposed longitudinally between the first and second annular longitudinal passage sections, wherein the opening in the baffle fluidly connects the first and second annular longitudinal passage sections.

3. The valve as set forth in claim 1, wherein the opening in the baffle extends through the radially outer edge margin of the baffle such that the radially outer edge margin engages the inner surface along a circumferential segment of the inner surface having an arc angle with respect to the valve axis of less than 360 degrees.

4. The valve as set forth in claim 1, wherein the opening in the baffle includes a plurality of openings spaced apart around the baffle.

5. The valve as set forth in claim 1, wherein the baffle is a first baffle, the valve stem further comprising a second baffle at a location spaced apart longitudinally from the first baffle, the second baffle extending radially outward from the stem body at a location downstream of the upstream portion, wherein a radially outer edge margin of the second baffle engages the interior surface of the seal downstream of the valve seat to restrict flow of the flowable product between the radially outer edge margin of the second baffle and the interior surface of the seal, wherein the second baffle defines an opening extending longitudinally therethrough in communication with the annular longitudinal passage section.

6. The valve as set forth in claim 5, wherein the openings in the first and second baffles are circumferentially.

7. The valve as set forth in claim 1, wherein the stem body has a cruciform cross-sectional shape.

8. The valve as set forth in claim 1, wherein the seal comprises a lip that extends radially inwardly from the interior surface toward the stem body.

9. The valve as set forth in claim 1, further comprising a nozzle having an opening defining an outlet of the valve passage, wherein the nozzle further comprises a nozzle baffle spaced apart along the longitudinal axis between the open end of the nozzle and the generally annular passage segment, the nozzle baffle defining a flow restriction along the valve passage between annular passage segment and the outlet.

10. A valve for dispensing flowable product from a container comprising:

a mounting cup for mounting the valve on the container;

a seal supported on the mounting cup, the seal having an interior surface defining a passage having a longitudinal axis, and a valve seat; and a valve stem including a stem body having a longitudinal axis extending from the disc and longitudinally within the passage of the seal, wherein at least a longitudinal portion of the stem body is free from engagement with the interior surface of the seal to define an annular longitudinal passage section therebetween, a disc coupled to the stem body and configured to sealingly engage the valve seat of the seal to inhibit flowable product from flowing into the annular longitudinal portion section, and a baffle extending radially outward from the stem body, wherein a radially outer edge margin of the baffle engages the interior surface of the seal to restrict flow of the flowable product between the radially outer edge margin of the baffle and the interior surface of the seal, wherein the baffle defines an opening extending longitudinally therethrough in communication with the annular longitudinal passage section, wherein the valve stem is rigid.

11. The valve as set forth in claim 10, wherein the annular longitudinal passage section includes first and second annular longitudinal passage sections, wherein the baffle is disposed longitudinally between the first and second annular longitudinal passage sections, wherein the opening in the baffle fluidly connects the first and second annular longitudinal passage sections.

12. The valve as set forth in claim 10, wherein the opening in the baffle extends through the radially outer edge margin of the baffle such that the radially outer edge margin engages the inner surface along a circumferential segment of the inner surface having an arc angle with respect to the valve axis of less than 360 degrees.

13. The valve as set forth in claim 10, wherein the opening in the baffle includes a plurality of openings spaced apart around the baffle.

14. The valve as set forth in claim 10, wherein the baffle is a first baffle, the valve stem further comprising a second baffle at a location spaced apart longitudinally from the first baffle, the second baffle extending radially outward from the stem body at a location downstream of an upstream portion, wherein a radially outer edge margin of the second baffle engages the interior surface of the seal downstream of the valve seat to restrict flow of the flowable product between the radially outer edge margin of the second baffle and the interior surface of the seal, wherein the second baffle defines an opening extending longitudinally therethrough in communication with the annular longitudinal passage section.

15. The valve as set forth in claim 14, wherein the openings in the first and second baffles are circumferentially.

16. The valve as set forth in claim 10, wherein the stem body has a cruciform cross-sectional shape.

17. The valve as set forth in claim 10, wherein the seal comprises a lip that extends radially inwardly from the interior surface toward the stem body.

18. The valve as set forth in claim 10, further comprising a nozzle having an opening defining an outlet of the valve passage, wherein the nozzle further comprises a nozzle baffle spaced apart along the longitudinal axis between the open end of the nozzle and the generally annular passage segment, the nozzle baffle defining a flow restriction along the valve passage between generally annular passage segment and the outlet.

* * * * *